US008512062B1

(12) United States Patent
Zhou

(10) Patent No.: US 8,512,062 B1
(45) Date of Patent: Aug. 20, 2013

(54) ELECTRONIC DEVICE HAVING ASSISTING APPARATUS FOR UNPLUGGING RJ-45 CONNECTOR

(75) Inventor: Hai-Qing Zhou, Shenzhen (CN)

(73) Assignees: Hong Fu Jin Precision Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/488,456

(22) Filed: Jun. 5, 2012

(30) Foreign Application Priority Data

Mar. 7, 2012 (CN) ..... 2012 1 0058079

(51) Int. Cl.
*H01R 13/627* (2006.01)

(52) U.S. Cl.
USPC ..... 439/352

(58) Field of Classification Search
USPC ..... 439/676, 541.5, 353, 352, 354, 344
See application file for complete search history.

(56) References Cited

U.S. PATENT DOCUMENTS

| | | | | |
|---|---|---|---|---|
| 5,308,260 | A * | 5/1994 | Johnston et al. | 439/344 |
| 7,037,141 | B1 * | 5/2006 | Huang | 439/676 |
| 7,314,384 | B2 * | 1/2008 | Togami et al. | 439/484 |
| 7,651,361 | B2 * | 1/2010 | Henry et al. | 439/352 |
| 7,686,638 | B2 * | 3/2010 | Boyd et al. | 439/344 |
| 7,800,037 | B2 * | 9/2010 | Sawtell et al. | 250/206 |
| 8,235,745 | B1 * | 8/2012 | Armstrong et al. | 439/352 |
| 8,267,712 | B2 * | 9/2012 | Huang et al. | 439/352 |
| 2008/0057772 | A1 * | 3/2008 | Peng et al. | 439/372 |
| 2012/0164868 | A1 * | 6/2012 | Huang et al. | 439/353 |
| 2013/0084731 | A1 * | 4/2013 | Gong et al. | 439/353 |

* cited by examiner

*Primary Examiner* — Neil Abrams
*Assistant Examiner* — Phuongchi T Nguyen
(74) *Attorney, Agent, or Firm* — Altis Law Group, Inc.

(57) ABSTRACT

An electronic device includes a chassis and an assisting apparatus for unplugging a Registered Jack-45 (RJ-45) connector having a resilient plate. The chassis includes a sidewall, and a connector installed in the chassis and exposed through the sidewall, for being connected to the RJ-45 connector. The assisting apparatus includes a fixing member mounted to the sidewall, a press member pivotably connected to the fixing member, and a torsion spring mounted between the fixing member and the press member. The press member includes a press portion protruding outwards. When the press member is rotated, the press portion presses the resilient plate of the RJ-45 connector, to allow the resilient plate to disengage from the connector of the chassis.

5 Claims, 5 Drawing Sheets

ELECTRONIC DEVICE HAVING ASSISTING APPARATUS FOR UNPLUGGING RJ-45 CONNECTOR

BACKGROUND

1. Technical Field

The present disclosure relates generally to electronic devices and, particularly, to an electronic device having an assisting apparatus for unplugging a Registered Jack-45 (RJ-45) connector.

2. Description of Related Art

RJ-45 connectors are widely used in network communication. However, unplugging an RJ-45 connector manually from a connector of an electronic device can be difficult and inconvenient because of limited space for maneuver.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
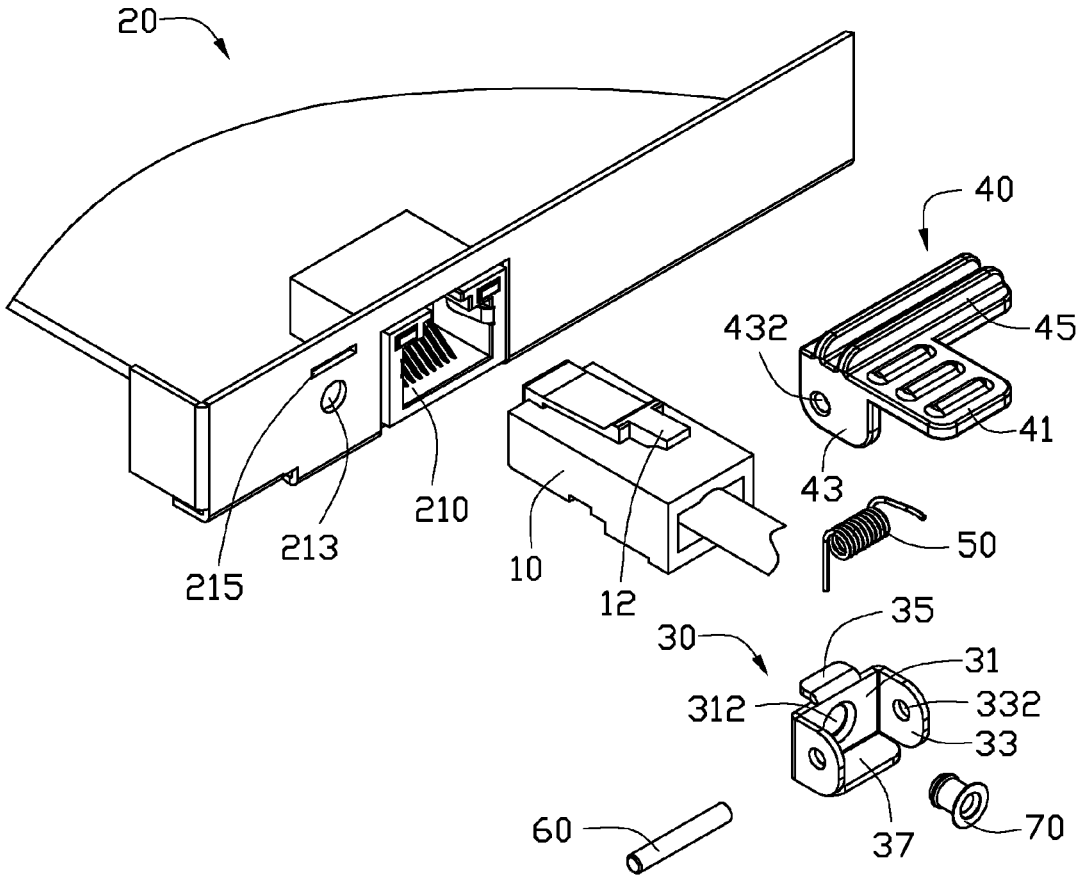
FIG. 1 is an exploded, isometric view of an exemplary embodiment of an electronic device together with a Registered Jack-45 (RJ-45) connector, wherein the electronic device includes an assisting apparatus for unplugging the RJ-45 connector, and the assisting apparatus includes a press member.
Figure 4:
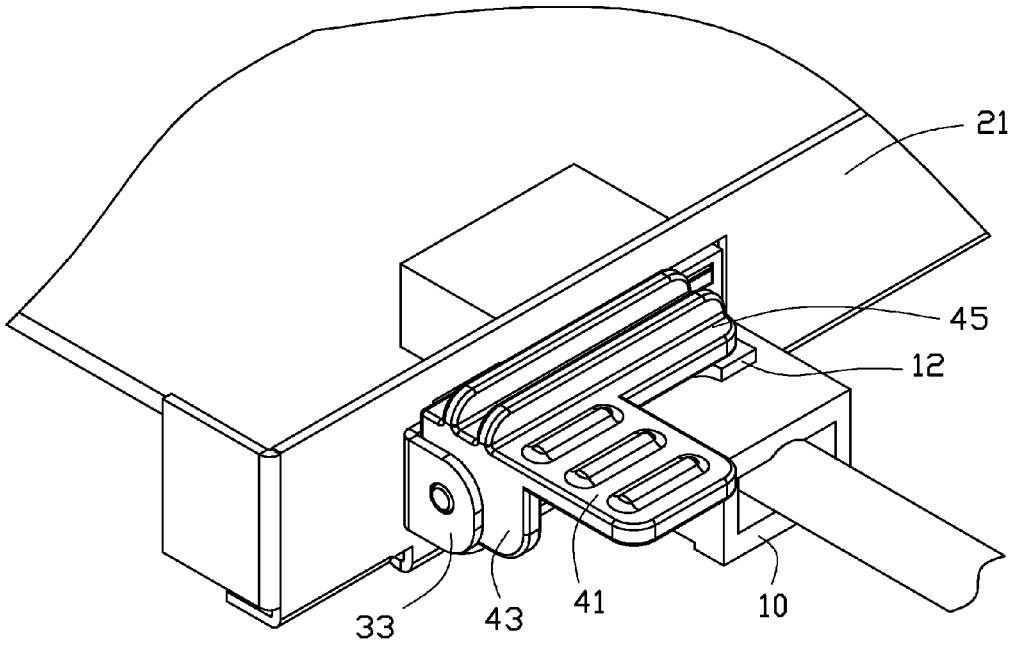
FIGS. 4 and 5 are assembled, isometric views of the electronic device and the RJ-45 connector of FIG. 1 in different states and perspectives.

FIGS. 1 and 4 show an exemplary embodiment of an electronic device including a chassis 20 and an assisting apparatus for unplugging a Registered Jack-45 (RJ-45) connector 10. The assisting apparatus includes a fixing member 30, a press member 40, and a torsion spring 50.

The chassis 20 includes a sidewall 21. A connector 210 is mounted inside the chassis 20 and exposed through the sidewall 21. A fixing hole 213 and a latching slot 215 are defined in the sidewall 21 adjacent to a side of the connector 210.

The RJ-45 connector 10 is connected to the connector 210. A resilient plate 12 slantingly extends up and back from a front end of a top of the RJ-45 connector 10 for engaging with a sidewall of the connector 210.

The fixing member 30 includes a fixing plate 31, two side plates 33 respectively extending back from opposite ends of the fixing plate 31 in a substantially perpendicular manner, a latching plate 35 extending forward from the top of the fixing plate 31, and a stop plate 37 extending back from the bottom of the fixing plate 31. A through hole 312 is defined in a middle of the fixing plate 31. A first pivot hole 332 is defined in a middle of each side plate 33. A latching hole 371 (see FIG. 3) is defined in the stop plate 37, adjacent to one of the side plates 33.

Figure 2:
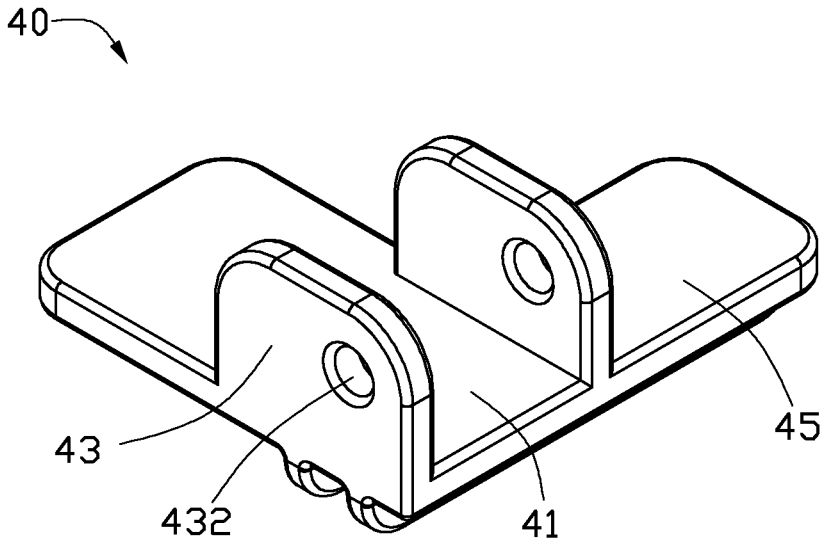
FIG. 2 is an enlarged, inverted view of the press member of FIG. 1.

Referring to FIG. 2, the press member 40 includes a main body 41 and two arms 43 respectively extending down from opposite sides of the front portion of the main body 41 in a substantially perpendicular manner. A second pivot hole 432 is defined in each arm 43, adjacent to the front end of the arm 43. A press portion 45 extends outward from one of the opposite sides of the front portion of the main body 41.

Figure 3:
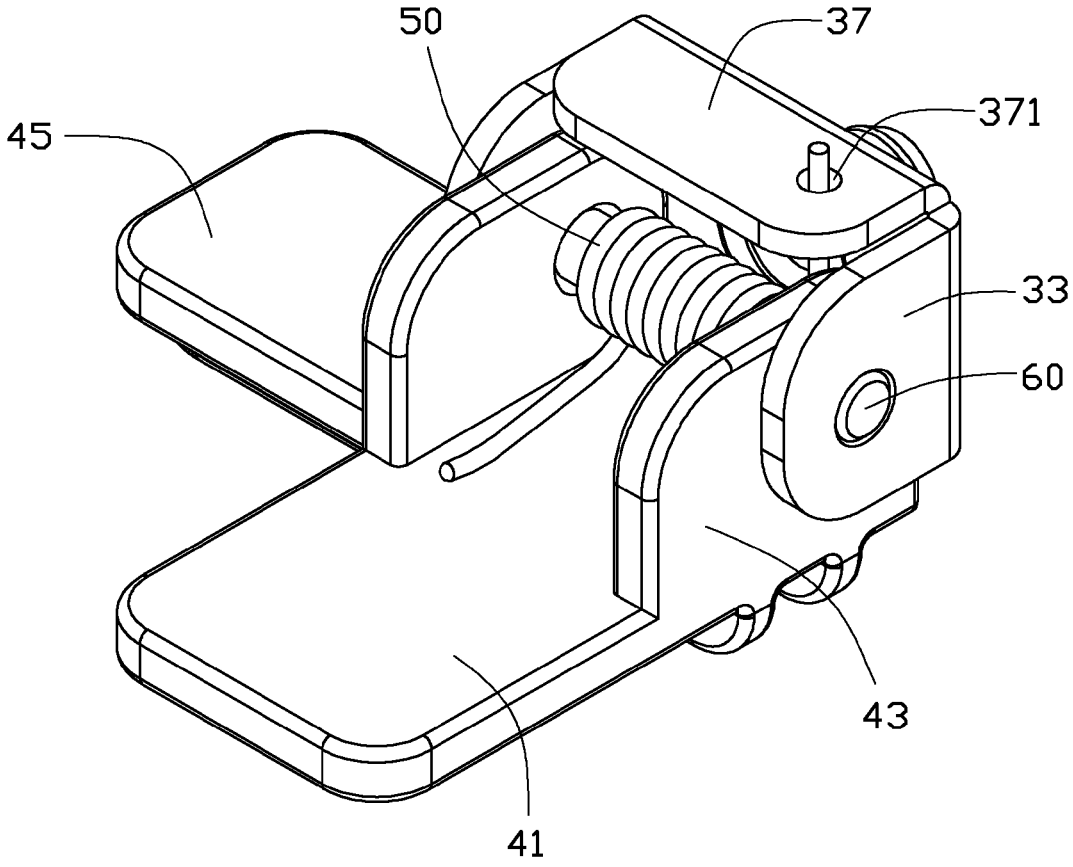
FIG. 3 is an assembled, isometric view of the assisting apparatus of FIG. 1 from another perspective.

Referring to FIGS. 3 and 4, in assembly, the latching plate 35 is inserted into the latching slot 215. A fastener 70 is extended through the through hole 312 and the fixing hole 213, to fix the fixing plate 31 to the sidewall 21. The arms 43 respectively contact the inner surfaces of the side plates 33, to allow the second pivot holes 432 to align with the first pivot holes 332. A shaft 60 is extended through one of the first pivot holes 332, one of the second pivot holes 432, the torsion spring 50, the other second pivot hole 432, and the other first pivot hole 332 in that order, to pivotably connect the press member 40 to the fixing member 30. A first end of the torsion spring 50 is inserted into the latching hole 371, and a second end of the torsion spring 50 abuts against the inner surface of the main body 41. When the torsion spring 50 is in an original state, the press portion 45 is horizontally arranged above the resilient plate 12.

Figure 5:
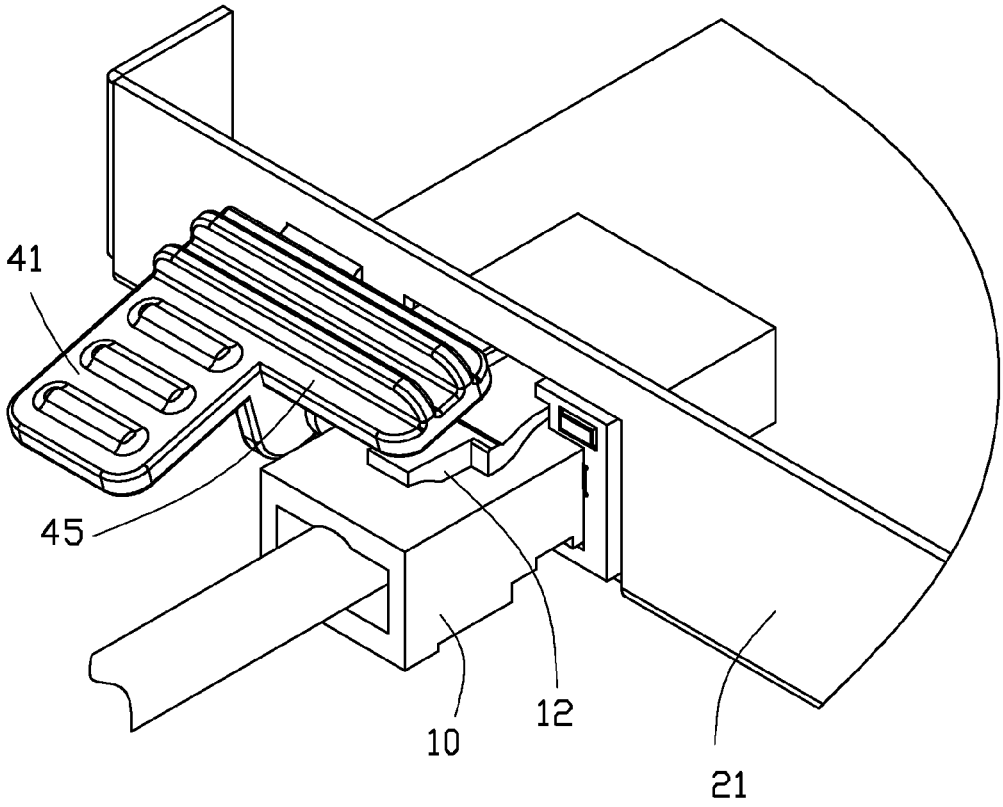

Referring to FIG. 5, to unplug the RJ-45 connector 10 from the connector 210, the rear end of the main body 41 is pressed down to allow the rear end of the press portion 45 to rotate downwards. The resilient plate 12 is pressed down by the press portion 45 to disengage from the connector 210. Thereby, the RJ-45 connector 10 can be detached from the connector 210.

Even though numerous characteristics and advantages of the embodiments have been set forth in the foregoing description, together with details of the structure and the functions of the embodiments, the disclosure is illustrative only, and changes may be made in details, especially in the matters of shape, size, and arrangement of parts within the principles of the embodiments to the full extent indicated by the broad general meaning of the terms in which the appended claims are expressed.

What is claimed is:

1. An electronic device, comprising:

a chassis comprising a sidewall, and a connector installed in the chassis and exposed through the sidewall, for being connected to a Registered Jack-45 (RJ-45) connector having a resilient plate to engage with the connector; and an assisting apparatus for unplugging the RJ-45 connector from the connector of the chassis, the assisting apparatus comprising a fixing member mounted to the sidewall, a press member pivotably connected to the fixing member, and a torsion spring mounted between the fixing member and the press member, wherein the press member comprises a press portion protruding outwards, when the press member is rotated, the press portion presses the resilient plate of the RJ-45 connector, to allow the resilient plate to disengage from the connector of the chassis.

2. The electronic device of claim 1, wherein the fixing member comprises a fixing plate mounted to the sidewall of the chassis and two side plates respectively extending away from the sidewall from opposite ends of the fixing plate in a substantially perpendicular manner, a first pivot hole is defined in each of the side plates, the press member comprises a main body and two arms respectively extending from opposite sides of a front portion of the main body in a substantially perpendicular manner, a second pivot hole is defined in each of the arms, a shaft extends through the first and second pivot holes, to pivotably connect the press member to the fixing member.

3. The electronic device of claim 2, wherein the press portion extends outward from one of the opposite sides of the front portion of the main body.

4. The electronic device of claim 3, wherein the torsion spring is placed around the shaft.

5. The electronic device of claim 4, wherein a stop plate extends from a side of the fixing plate away from the main body of the press member, a latching hole is defined in the stop plate, a first end of the torsion spring is inserted into the latching hole, and a second end of the torsion spring abuts against an inner surface of the main body of the press member.

* * * * *